US007219829B2

(12) United States Patent
Treat

(10) Patent No.: US 7,219,829 B2
(45) Date of Patent: May 22, 2007

(54) CARRIER WHICH IS AESTHETICALLY IRREVERSIBLY CONVERTIBLE FROM PLANAR BLANK TO CLOSED PACKAGE FOR CODED CARD AND METHODS FOR MANUFACTURE AND USE OF THE SAME

(76) Inventor: Tracey Treat, 942 Thorne Dr., West Chester, PA (US) 19382

( * ) Notice: Subject to any disclaimer, the term of this patent is extended or adjusted under 35 U.S.C. 154(b) by 353 days.

(21) Appl. No.: 10/744,053

(22) Filed: Dec. 22, 2003

(65) Prior Publication Data

US 2004/0146688 A1 Jul. 29, 2004

Related U.S. Application Data

(60) Provisional application No. 60/436,300, filed on Dec. 24, 2002.

(51) Int. Cl.
*B42D 15/00* (2006.01)
*B65D 27/04* (2006.01)
*B65D 27/22* (2006.01)

(52) U.S. Cl. ..... 229/92.8; 229/71; 229/84; 283/82

(58) Field of Classification Search ..... 229/82, 229/84, 92.8, 71; 283/82
See application file for complete search history.

(56) References Cited

U.S. PATENT DOCUMENTS 4,360,106 A * 11/1982 Irvine et al. ..... 229/212
4,937,963 A * 7/1990 Barnes ..... 40/661.06
4,948,034 A * 8/1990 Rohloff ..... 229/92.8
5,518,787 A 5/1996 Konkol ..... 428/43
5,609,253 A 3/1997 Goade, Sr. ..... 206/460
5,650,209 A 7/1997 Ramsburg et al. ..... 428/43
5,720,158 A 2/1998 Goade, Sr. ..... 53/460
5,760,381 A 6/1998 Stich et al. ..... 235/380
5,791,474 A 8/1998 Hansen ..... 206/449
5,884,456 A 3/1999 Hansen ..... 53/467
5,915,733 A 6/1999 Schnitzer et al. ..... 238/108
5,918,909 A 7/1999 Fiala et al. ..... 283/61
5,921,584 A 7/1999 Goade, Sr. ..... 283/107
5,958,174 A 9/1999 Ramsberg et al. ..... 156/277
D416,246 S 11/1999 Hileman ..... D14/117
6,024,277 A * 2/2000 Martin ..... 229/71
6,109,439 A 8/2000 Goade, Sr. ..... 206/454
6,145,665 A 11/2000 Krahn ..... 206/756
6,193,163 B1 2/2001 Fehrman et al. ..... 235/488
6,224,108 B1 5/2001 Klure ..... 283/74
6,270,012 B1 8/2001 Dawson ..... 235/381
6,299,530 B1 * 10/2001 Hansted et al. ..... 462/64
6,315,206 B1 11/2001 Hansen et al. ..... 235/487
6,321,911 B1 11/2001 Raimer et al. ..... 206/509
6,328,341 B2 12/2001 Klure ..... 283/62
6,349,829 B1 2/2002 Matheis et al. ..... 206/449
6,375,081 B1 4/2002 Hileman et al. ..... 235/487
6,439,613 B2 8/2002 Klure ..... 283/62
6,454,165 B1 9/2002 Dawson ..... 235/381
6,457,649 B1 10/2002 Hileman ..... 235/486
6,619,480 B2 * 9/2003 Smith ..... 206/555
6,732,459 B1 * 5/2004 Clark ..... 40/124.06
2001/0022446 A1 9/2001 Klure ..... 283/62
2001/0045738 A1 11/2001 Klure ..... 283/61

(Continued)

*Primary Examiner*—Jes F. Pascua
(74) *Attorney, Agent, or Firm*—Charles N. Quinn

(57) ABSTRACT

A planar carrier for a coded card is substantially aesthetically irreversibly convertible from a substantially two-dimensional blank into a three-dimensional card enclosing gift package.

12 Claims, 10 Drawing Sheets

U.S. PATENT DOCUMENTS

2002/0043558 A1 4/2002 Dawson ..... 235/381
2002/0100797 A1* 8/2002 Hollingsworth et al. ... 229/92.8
2002/0139699 A1 10/2002 Hansen et al. ..... 206/308.1

* cited by examiner

CARRIER WHICH IS AESTHETICALLY IRREVERSIBLY CONVERTIBLE FROM PLANAR BLANK TO CLOSED PACKAGE FOR CODED CARD AND METHODS FOR MANUFACTURE AND USE OF THE SAME

CROSS REFERENCE TO RELATED PATENT APPLICATION

This patent application claims the benefit of the filing date of provisional U.S. patent application Ser. No. 60/436,300 filed 24 Dec. 2002 in the name of Tracey Treat and entitled "CARRIER WHICH IS AESTHETICALLY IRREVERSIBLY CONVERTIBLE FROM PLANAR BLANK TO CLOSED PACKAGE FOR CODED CARD AND METHOD FOR USE OF SAME"; the priority claim is made under 35 U.S.C. 119(e).

BACKGROUND OF THE INVENTION

This invention relates to packaging and carriers for coded cards, such as phone cards, bank cards, credit cards, debit cards and other merchant-specific cards.

Coded cards are well-known and widely used for a variety of purposes, examples being credit cards, debit cards, rental cards, bank cards and the like. In more a recent application of coded cards, such cards are used to secure or extend credit for prepaid products or services. Examples of this are phone cards. The phone card carries a pre-paid amount of credit which the card user, typically the bearer, exhausts as the card user makes telephone calls using the phone card.

Pre-paid gift cards have exploded in popularity and carry with them an amount of pre-paid credit for which the donor has typically paid. Such gift cards represent a cash equivalent when the pre-paid gift card is presented by the donor to a donee.

Whatever the type of pre-paid coded card, to reduce the risk of theft, such cards sold in a retail environment are stored or displayed with the cards being inactive. These so-called "pre-paid" cards require activation before the card may be used. Desirably, card activation is performed at the time the card is purchased. Activation is typically performed by machine-reading a unique identification number encoded on the card, with the machine-reading being performed at the point-of-sale of the coded card. Typically a unique identification number for the card is stored on a magnetic strip or as part of a bar code which is printed on or otherwise permanently attached to the rear of the card.

The card identification number is read by the card reader machine as the portion of the card where the magnetic strip or bar code is located is brought into proximity with the card reader. This is typically done by passing the card portion on which the magnetic strip or bar code is located along a reading head of a card reader machine which magnetically or optically senses the unique identification number encoded in the magnetic strip or bar code associated with that card. During the card activation process the card usually, but not always, remains attached to a cardboard carrier via which the card is displayed in the retail environment. The card reader machine transmits the unique identification number which has been read for the particular card to a central computer, which typically is remotely located relative to the point-of-sale locale of the card. The computer "activates" the card by accessing account information corresponding to the card number, which account information is stored within the central computer, and "opening" the account for that particular card. Once the card has been "activated" in this manner, the bearer of the card can purchase goods or services, using the card as cash, in an amount equal to the value which has been assigned to the account associated with the card. Whenever the card is used, the central computer debits the account corresponding to the card until the value of the account for the card is zero. At that point the account is closed or otherwise inactivated and the card can no longer be used.

DESCRIPTION OF THE PRIOR ART

U.S. Pat. No. 5,918,909 discloses packaging for holding a coded card in a manner that even though the card is retained by the packaging, a data-encoded strip, such as a magnetic strip or a bar code, is exposed. The package includes a first panel and a retainer securing the card to the panel so that while the card is secured to the panel, a portion of the card extends beyond the panel edge, exposing the magnetic strip or bar code. In this manner the magnetic strip or bar code of the card may be read by a machine reader without removing the card from the packaging.

U.S. Pat. No. 5,918,909 further discloses a method for activating a so-called "metered" account which is associated with the unique personal identification number of the card, where the personal identification number is affixed to a coded card. In the practice of the method, a control number is read from the magnetic strip or bar code of the card as the card remains secured to a panel of the carrier. A portion of the card extends beyond the carrier panel edge so as to expose the magnetic strip or bar code for reading by a machine reader thereby to activate the metered account.

In both the method and apparatus disclosed in U.S. Pat. No. 5,918,909, the coded card is affixed to the carrier panel portion with the card edge extending beyond the edge of the carrier panel; the card remains affixed to the carrier panel while the card is read and hence activated.

U.S. Pat. No. 6,315,206 discloses a wallet card package for a coded card in which the coded card is secured to a panel portion of the package, where the panel portion of the package includes a card carrying flap which pivots about a fold line. The coded card is secured to and carried by the card carrying flap so that the so-called "package" for the card, which essentially consists of only a flat sheet, is selectably convertible, by movement of the card carrying flap, from a closed position at which a magnetic strip on the card is covered, to an open position at which the card may be swung out from the "package", while remaining secured to the card carrying flap, in order expose the magnetic strip so the coded card and the account associated therewith may be activated.

U.S. Pat. No. 6,315,206 discloses several configurations of such a package, in all of which the coded card remains affixed to the card carrying flap so that the coded card may "flip" or hinge out from between front and rear panels, which constitute the "package" or sheet, for point-of-sale activation, while the card remains secured to the package. The '206 coded card is secured to and carried by the card carrying flap such that the coded card moves with the flap, as taught by U.S. Pat. No. 6,315,206 at column 2, lines 34 through 43. In U.S. Pat. No. 6,315,206, the coded card and the card carrying flap on which the coded card is mounted can be swung pivotally back into the card carrying flap closed position, at which the magnetic strip cannot be accessed, after the magnetic strip has been read. This return to the closed position with such pivotal action allegedly provides protection for the coded card, as asserted at column 3, lines 13 through 16 of U.S. Pat. No. 6,315,206.

SUMMARY OF THE INVENTION

In one of its aspects this invention provides a carrier for a coded card. The carrier is desirably initially substantially configured in the form of a preferably substantially planar blank which serves initially as a display for the coded card; the blank preferably is substantially aesthetically irreversibly convertible into a card-enclosing aesthetically pleasing package, most desirably a gift package. In this aspect of the invention the carrier in the form of the blank serves as a display which prior to package conversion is essentially planar with the blank serving as the display being somewhat flexible, but not easily bendable while yet being somewhat stiff and a little rigid and preferably laminated with plastic on at least one side. The base material of the blank is preferably non-corrugated, single thickness cardboard or paperboard, preferably in the range of about 0.020 to 0.050 inches thick.

In this aspect of the invention, the blank (serving as the display), preferably includes a first panel of generally rectangular configuration, a pair of foldable flaps connecting to the first panel preferably oppositely one from another along fold lines which define segments of respective longitudinally elongated edges of the first panel. The flaps are preferably adapted to fold towards one another along the fold lines thereby to overlie respective portions of the rear surface of the first panel.

The carrier, whether in the planar blank or card-display configuration, preferably further includes and exhibits a lower panel of generally rectangular configuration which preferably connects to the first panel along a fold line defining juncture therebetween. The lower panel is adapted to fold, preferably subsequently to the flaps folding, along the associated lower panel-first panel juncture-defining fold line, with the lower panel folding being back and upwardly towards to the first panel in order that the rear surface of the lower panel may facingly overlie the rear surface of the first panel and the folded pair of flaps which preferably already overlie respective parts of the rear surface of the first panel. When the lower panel is folded in this manner, the lower panel, the two folded flaps and a part of the rear surface of the first panel define a card receptacle pocket in the space between the (now) mutually facing rear surfaces of the first and lower panel. The lower panel may further include an aperture therethrough, proximate or just below the center of the lower panel, once the lower panel has been folded upwardly into position.

In this aspect of the invention, the carrier preferably yet further includes an upper panel of generally rectangular configuration which connects to the first panel along a fold line defining juncture therebetween. The upper panel is preferably adapted to fold along the associated upper panel—first panel juncture-defining fold line towards the rear surface of the first panel, after the folding of the lower panel into position with the rear surface of the lower panel facing the rear surface of the first panel. In this manner the upper panel overlies a part of what was the front surface of the lower panel, preferably between the aperture (in the embodiment in which an aperture is provided) and a free edge of the lower panel (which defined the lower extremity of the carrier prior to folding).

The upper panel preferably further includes a tab positioned along and extending from an upper edge extremity of the upper panel defined by the horizontal or transversely extending fold line which in turn defines juncture of the upper and first panels. The tab is preferably adapted for preferably interfering insertion into the aperture in the lower panel after first folding of the lower panel into position in mutually facing rear surface relationship with the first panel and after second folding of the upper panel to overlie the part of the lower panel between the aperture (in the embodiment in which an aperture is provided) and the lower panel free edge which had defined the front surface of and a lower extremity of the lower panel and hence of the carrier prior to folding.

Insertion of the tab into the aperture serves to interferingly retain the upper and lower panels in closely facing engagement one with another thereby to define a gift package retaining therewithin any coded or other card or object which may reside in the receptacle pocket formed by the now-folded flaps, the now-folded lower panel and the lower part of the rear surface of the first panel.

The carrier preferably further includes a preferably coplanar apertured hang panel connecting to the upper panel along a manually separable perforate line defining the upper edge extremity of the upper panel. The apertured hang panel is adapted to be removed and discarded before converting the blank into the card-enclosing gift package, and preferably includes a punch-out encircled blank which can be manually removed in order that the carrier may be displayed by being hung from a horizontal hanger rod in a retail environment. When displayed by hanging in the retail environment, the carrier is in the planar disposition since the hangtag is still affixed to the upper panel, thereby precluding the upper panel from being folded as the final step in forming the three dimensional gift package.

Most desirably, the flaps and the lower panel are folded into position and may be adhered with temporary or permanent adhesive, to form a receptacle into which the coded card may be placed after the card has been removed from the front of the carrier and activated by store sales personnel. Further desirably, the flaps and lower panel have been folded into position and the adhesive applied to form the card receptacle prior to the carrier, desirably having an unactivated coded card affixed to the carrier front surface, being put on display in the retail environment.

In another aspect of the invention there is provided a planar carrier for a coded card which is convertible from a flat blank into a three-dimensional card-enclosing gift package. The carrier includes a blank which prior to package conversion is preferably essentially planar. The blank preferably comprises a first panel and foldable flaps connected to the first panel along fold lines defining respective edges of the first panel. The flaps are adapted to fold towards one another along the fold lines to overlie a rear surface of the first panel. When the carrier is in the planar configuration, prior to conversion into the three-dimensional gift package, a coded card is preferably removably secured to the front surface of the first panel or, alternatively and most preferably, to the front surface of the upper panel.

In this aspect of the invention the blank preferably further includes a lower panel connecting to the first panel along a fold line defining juncture therebetween with the lower panel being adapted to fold along the associated juncture-defining fold line upwardly to facingly overlie the rear surface of the first panel and the flaps. This defines a card receptacle pocket between the now mutually facing surfaces of the first and lower panels, with the lower panel optionally having an aperture therethrough. Adhesive is preferably used to secure the lower panel to the flaps.

The blank preferably further includes an upper panel connecting to the first panel along the fold line defining juncture therebetween and being adapted to fold towards the rear surface of the first panel to overlie at least the part of the lower panel between the aperture, if an aperture is provided, and an upper edge of the lower panel. The upper panel preferably includes a tab adapted for interfering insertion into the aperture in the lower panel after folding of the lower panel into facing relationship with the first panel and after folding of the upper panel to overlie part of the lower panel. Tab insertion serves to retain the upper and lower panels in closely facing engagement one with another thereby to retain within the resulting substantially closed three-dimensional package any card, most desirably a coded card which has been manually removed (if necessary) from the front surface of the upper panel, activated by store personnel and placed into the receptacle, residing within the receptacle pocket.

In another one of its aspects this invention provides a planar carrier for a coded card which is substantially aesthetically irreversibly convertible from a substantially two-dimensional blank into a two-dimensional blank into a three-dimensional card—enclosing gift package manufactured according to a specific series of steps, where the planar carrier includes a blank which prior to package conversion is essentially planar with the blank being essentially rigid and laminated with plastic on at least one side and where the blank further includes a first panel of generally rectangular configuration.

The blank preferably further includes a pair of foldable flaps connecting to the first panel oppositely one from another along fold lines defining portions of respective longitudinally elongated edges of the first panel with the flaps being adapted to fold towards one another along the fold lines to thereby overlie respective portions of a rear surface of the first panel. The blank preferably further includes a lower panel of generally rectangular configuration connecting to the first panel along the fold line defining juncture therebetween with the lower panel being adapted to fold subsequently to the flaps along the associated juncture-defining fold line upwardly to facingly overlie the rear surface of the first panel and the folded pair of flaps overlying respective parts of the rear surface of the first panel to define a card receptacle pocket and space between the now mutually facing surfaces of the first and lower panels with the lower panels having an aperture therethrough approximate the center of the lower panel.

The blank further includes an upper panel portion of generally rectangular configuration connecting the first panel portion along a fold line defining the juncture therebetween and being adapted to fold along the associated juncture—defining the fold line towards said rear surface of said first panel portion after folding of said lower panel portion into position facing said first panel portion thereby to overlie a part of said lower panel portion between said aperture and a free edge of said lower panel portion which defines the lower extremity of the blank prior to folding. The upper panel portion preferably includes a tab portion positioned along and extending from an upper edge extremity of said upper panel portion with the tab portion being adapted for interfering insertion into the aperture and the lower panel portion after first folding of the lower panel portion into facing relationship with the first panel portion after second folding of the upper panel portion to overlie the part of the lower panel portion between the aperture and the lower panel portion free edge which had defined the lower extremity of the blank prior to folding to retain the upper and lower panel portions in closely facing engagement one with another thereby to retain therewithin any card residing within the receptacle pocket.

The panel preferably further includes a manually detectable apertured hang panel connecting to said upper panel along a manually separable perforate line defining said upper edge extremity of said panel portion.

The panel is fabricatingly converted from the substantially two-dimensional blank into a three-dimensional card enclosing gift package according to a method including the steps of folding the pair of foldable flaps connecting to the first panel oppositely one from another along fold lines defining respective portions of respective longitudinally elongated edges of the first panel, with the folding being done towards one another along the fold lines to thereby overlie respective portions of a rear surface of the first panel. The folding further includes folding the lower panel of generally rectangular configuration connecting to the first panel along the fold line defining juncture therebetween subsequently to the flaps along the associated juncture-defining fold line upwardly to facingly overlie the rear surface of the first panel and the folded pair of flaps overlying respective parts of the rear surface of the first panel to define the card receptacle pocket in space between now mutually facing surfaces of the first and lower panels. The folding further includes folding the upper panel portion of generally rectangular configuration along the fold line towards the rear surface of the first panel portion after folding of the lower panel portion into position facing the first panel portion to overlie the lower panel portion between an aperture therein and a free edge of the lower panel portion which defined the lower extremity of the lower panel portion prior to folding.

Converting the blank into the three-dimensional card enclosing gift package further includes the step of interferingly inserting the tab into the aperture in the lower panel portion after first folding of the lower panel portion into facing relationship with the first panel portion and after second folding of the upper panel portion to overlie the part of the lower panel portion between the aperture and the lower panel portion free edge which had defined the lower extremity of the lower panel portion prior to folding to retain the upper and lower panel portions in closely facing engagement with one another thereby to retain therewithin any card residing within receptacle pocket.

In yet another one of its aspects, this invention provides a planar carrier for a coded card which is convertible from a flat blank to a three-dimensional card enclosing gift package according to a specific series of steps where the carrier includes a blank which prior to package conversion is essentially planar and comprising a first panel, flaps connecting to the first panel and adapted to fold towards one another to overlie a rear surface of the first panel, a lower panel connecting to the first panel along the fold line defining juncture therebetween and being adapted to fold along the associated juncture-defining fold line to facingly overlie the first panel and the flaps to define a card receptacle pocket between the now mutually facing surfaces of the first and lower panels, an upper panel connected to the first panel along a fold line defining juncture therebetween and being adapted to fold towards the rear surface of the first panel to overlie the lower panel, with the upper panel including means for retaining the upper and lower panel in closely facing engagement one with another thereby to retain in a resulting substantially closed three-dimensional package any card residing within what had been the receptacle pocket where the conversion of the two-dimensional flap blank to the three-dimensional card enclosing gift package is performed at least in part by folding a pair of foldable flaps connecting the first panel oppositely one from another along fold lines defining respective portions of respective longitudinally elongated edges of the first panel, with the folding of the flaps being towards one another along the fold lines to thereby overlie respective portions of the rear surface of the first panel.

The folding further includes folding a lower panel connecting to the first panel along a fold line defining juncture therebetween subsequently to the flaps being folded along the associated juncture-defining fold line upwardly to facingly overlie the rear surface of the first panel and the folded pair of flaps overlying respective parts of the rear surface of the first panel to define a card receptacle pocket in space between the now mutually facing surfaces of the first and lower panels with the folding yet further including folding the upper panel portion along the fold line towards the rear surface of the first panel portion after folding of the lower panel portion into position facing said first panel portion to overlie a part of said lower panel portion between an aperture therein and a free edge of said lower panel portion which defined the lower extremity of the lower panel prior to folding where the steps for conversion further include interferingly inserting the tabs into the aperture into the lower panel after first folding the lower panel portion into facing relationship with the first panel portion and after second folding of the upper panel portion to overlie the part of the lower panel portion between the aperture and the lower panel portion free edge which had defined the lower extremity of the lower panel portion prior to folding, to retain the upper and lower panel portions in closely facing engagement one with another thereby to retain therewithin any card residing within the receptacle pocket.

In the description of the invention the carrier is described as being "aesthetically irreversibly" (sometimes using variants thereof) convertible from the two dimensional blank form into the three dimensional package form. "Aesthetically irreversible" signifies that once the carrier has been converted from the two dimensional blank form into the three dimensional package form, any attempt to re-convert the three dimensional package back into the two dimensional blank will result in a blank which will be wrinkled, unsightly, probably very non-planar, generally not appealing to the eye and essentially unusable in a retail environment as a carrier for a coded card or for anything else.

DETAILED DESCRIPTION OF THE PREFERRED EMBODIMENTS OF THE INVENTION INCLUDING THE BEST MODE KNOWN FOR PRACTICE THEREOF

Figure 1:
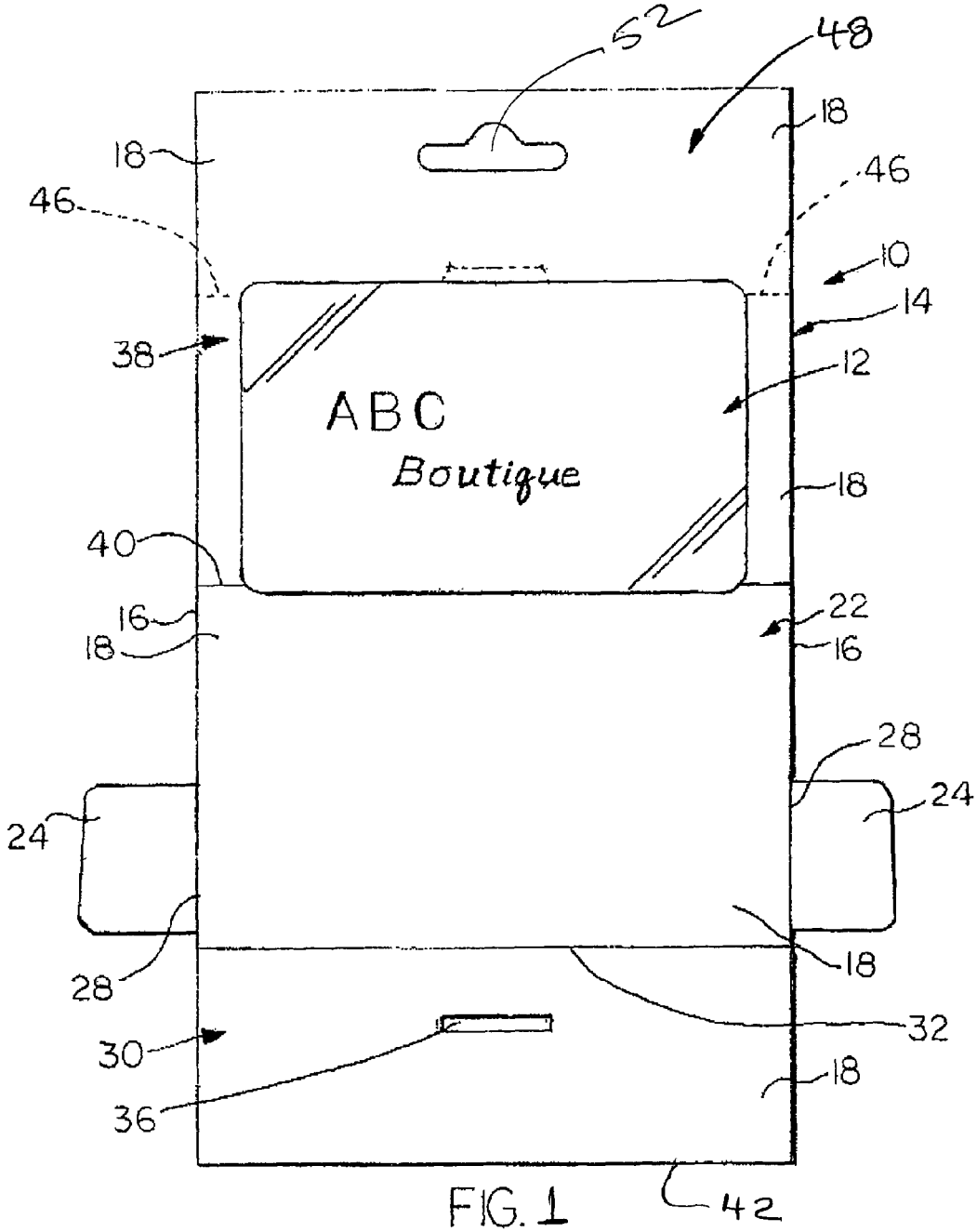
FIG. 1 is a front view of a carrier for a coded card in accordance with the preferred embodiment of the invention, with the carrier configured as a planar blank, with the drawing looking at the front surface of the blank and with a coded card in position on the front surface of an upper panel portion of the blank and being removably secured to the blank.

Referring to the drawings in general and to FIG. 1 in particular, a carrier for a coded card, which carrier is substantially aesthetically irreversibly convertible from a substantially two dimensional blank into a three-dimensional card enclosing gift package, is designated generally 10 and serves as a carrier for a coded card designated generally 12. Carrier 10 includes a blank designated generally 14 which prior to package conversion of the carrier is essentially planar, as is apparent from FIGS. 1 through 8. Blank 14 is preferably essentially rigid cardboard, paperboard or a material-like cardboard and is further preferably laminated with plastic or some other transparent protective coating on least one side of blank 14.

Blank 14 further includes a first panel designated generally 22 which is preferably of generally rectangular configuration as shown in FIG. 1. Blank 14 further preferably includes at least one and preferably a pair of foldable flaps where each flap is designated generally 24 and is connected to panel 22 along lateral or vertically extending (when blank 14 is oriented as shown in the drawings) edges of panel 22. Flaps 24 are connected to first panel 22 along preferably scored or otherwise structurally weakened fold lines designated generally 28 in the drawings. Fold lines 28 define respective portions of respective longitudinally elongated edges 16 of first panel 22. The connections between flaps 24 and first panel 22 are preferably at or close to the lower extremity of first panel 22, proximate to lower panel 18, as illustrated in the drawings.

Figure 8:
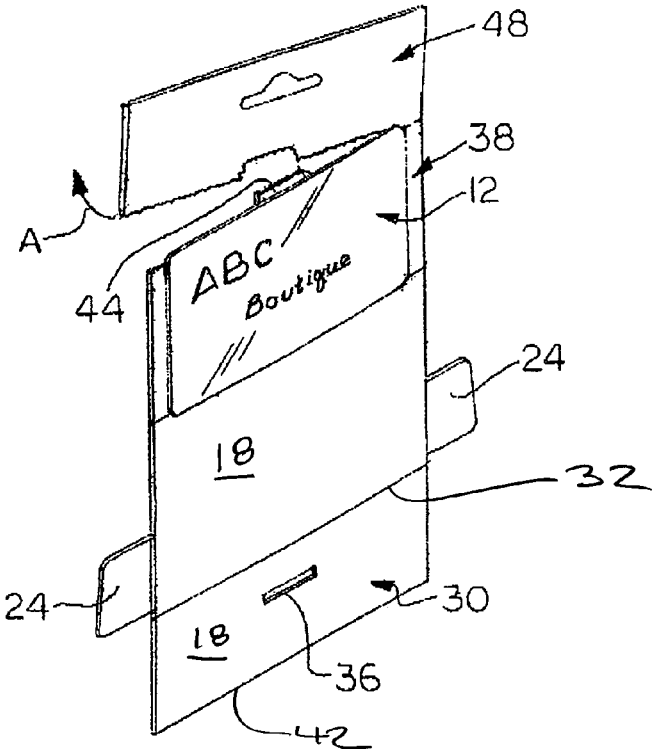
FIG. 8 is an isometric view, looking at the front surface, of a carrier for a coded card, with a coded card positioned on front surface of an upper panel portion of the blank, as the card might be positioned after being activated (and removed and re-attached to the carrier, if need be) by a retail clerk subsequent to sale, showing a hang panel portion being detached from the remainder of the blank.
Figure 9:
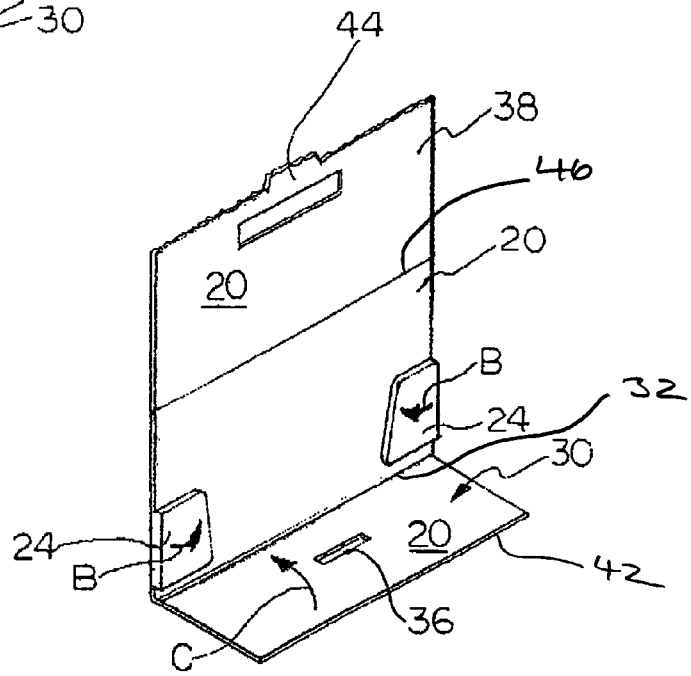
FIG. 9 is an isometric view, looking at the real surface, of the carrier for a coded card illustrated in FIG. 8, having the hang panel removed therefrom and illustrating initial steps for irreversibly aesthetically converting the carrier for the coded card from the two dimensional blank form into the three dimensional card-enclosing package form.
Figure 10:
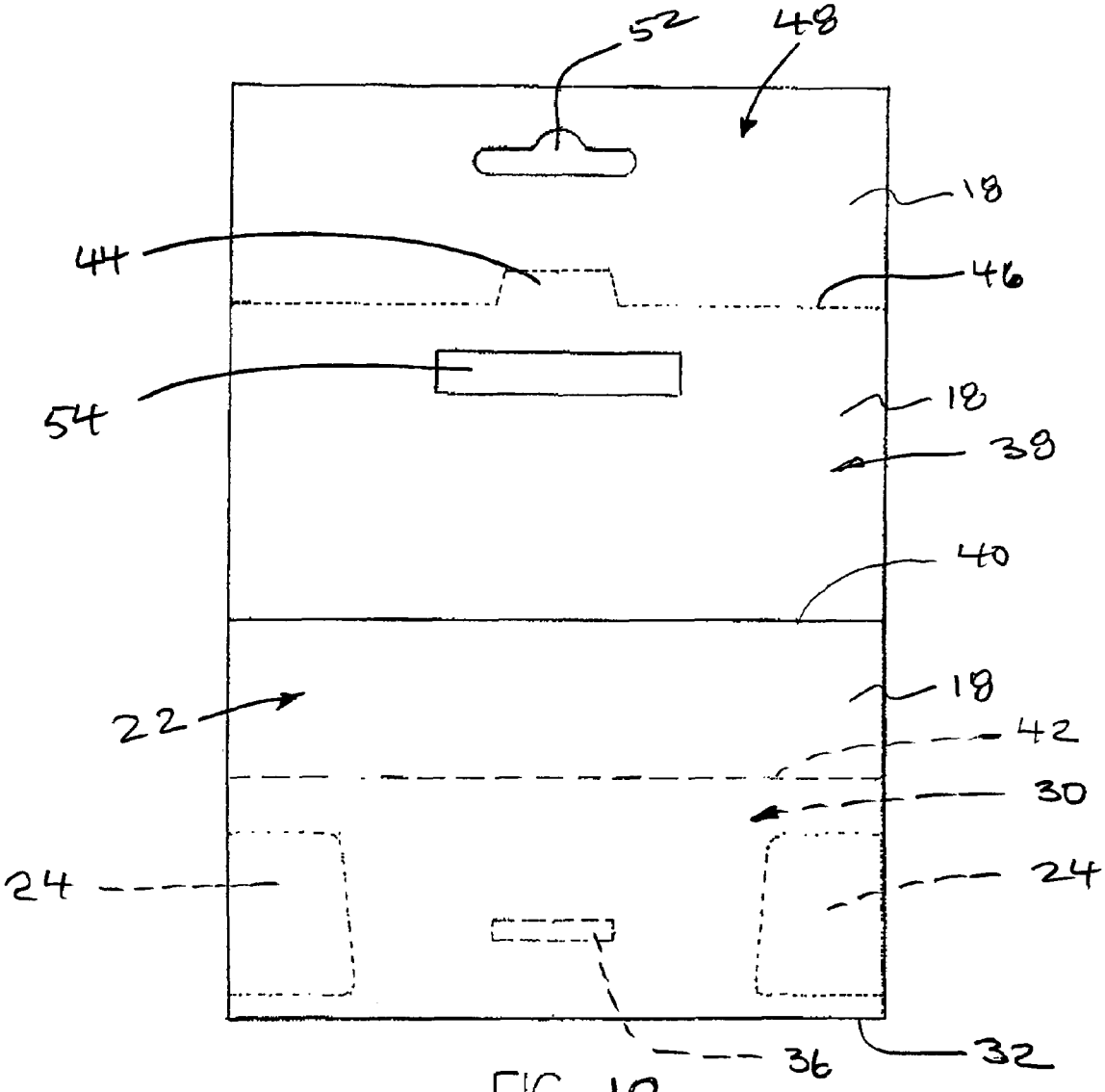
FIG. 10 is a front view of a carrier for a coded card in accordance with the preferred embodiment of the invention, with the foldable flaps and the lower portion illustrated in dotted lines as having been folded into position to form a pocket for receipt of a coded card.
Figure 11:
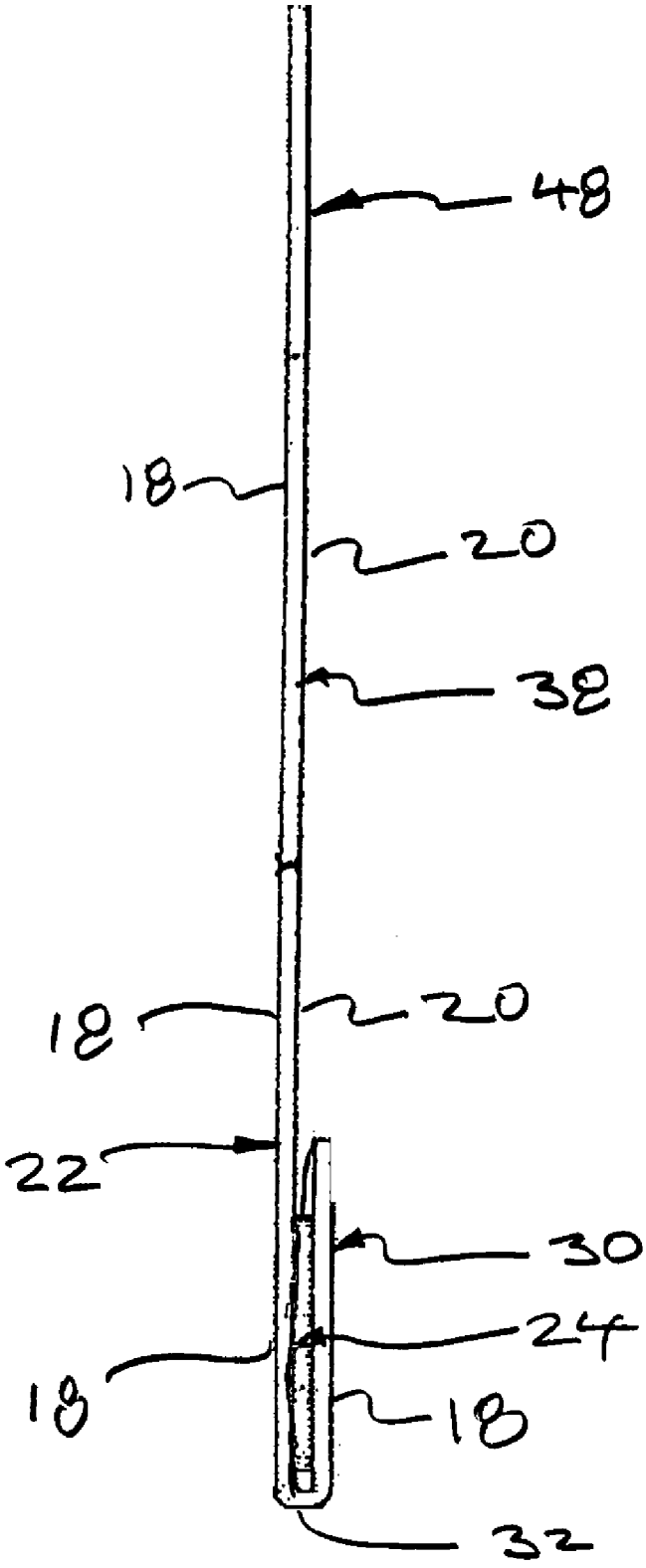
FIG. 11 is a side view of the carrier for a coded card illustrated in FIG. 10, looking from right to left in FIG. 10, with the foldable flaps and the lower portion illustrated as having been folded into position to form a pocket for receipt of a coded card.

Flaps 24 are adapted to fold towards one another, as shown by arrows B in FIG. 9, along fold lines 28 in a manner that flaps 24 can overlie, as illustrated in FIG. 10 and especially in FIG. 11, respective portions of a rear surface 20 of blank 14 of which first panel 22 forms a part. Folding of flaps 24 to overlie respective portions of rear surface 20 is additionally depicted in FIGS. 8 and 9. All of rear surface of blank 14 is designated 20 in the drawings prior to folding of blank 14, no matter whether the surface portion of interest is part of first panel 22 of blank 14, part of lower panel 30 of blank 14, part of upper panel 38 of blank 14, etc.

The front surface of first panel 22 is designated generally 18 in the drawings. As with the rear surface 20 of blank 14, all of the front surface of blank 14 prior to folding of blank 14 is designated 18 in the drawings, no matter whether the front surface portion of interest is part of first panel 22 of blank 14, part of lower panel 30 of blank 14, part of upper panel 38 of blank 14, etc.

Blank 14 further includes a lower panel which is designated generally 30 in the drawings and which is preferably of generally rectangular configuration. Lower panel 30 preferably connects to first panel 22 along a preferably scored or otherwise structurally weakened fold line 32 which defines juncture between first panel 22 and lower panel 30. The lower extremity of lower panel 30, which is the bottom edge of blank 14 prior to folding of lower panel 30, is designated 42 in the drawings.

Lower panel 30 is adapted to fold rearwardly, as shown by arrow C in FIG. 9, subsequently to the folding of flaps 24 along fold lines 32, in an upwardly direction, as depicted in FIG. 9. Consequently, when lower panel 30 is folded upwardly, lower panel 30 facingly overlies rear surface 20 of first panel 22 and flaps 24 and also overlies rear surface 20 of first panel 22. In this manner flaps 24 serve to separate at least a part of lower panel 30, namely the surface which is the rear surface prior to lower panel 30 being folded, from rear surface 20 of first panel 22, as illustrated in FIG. 11.

Figure 12:
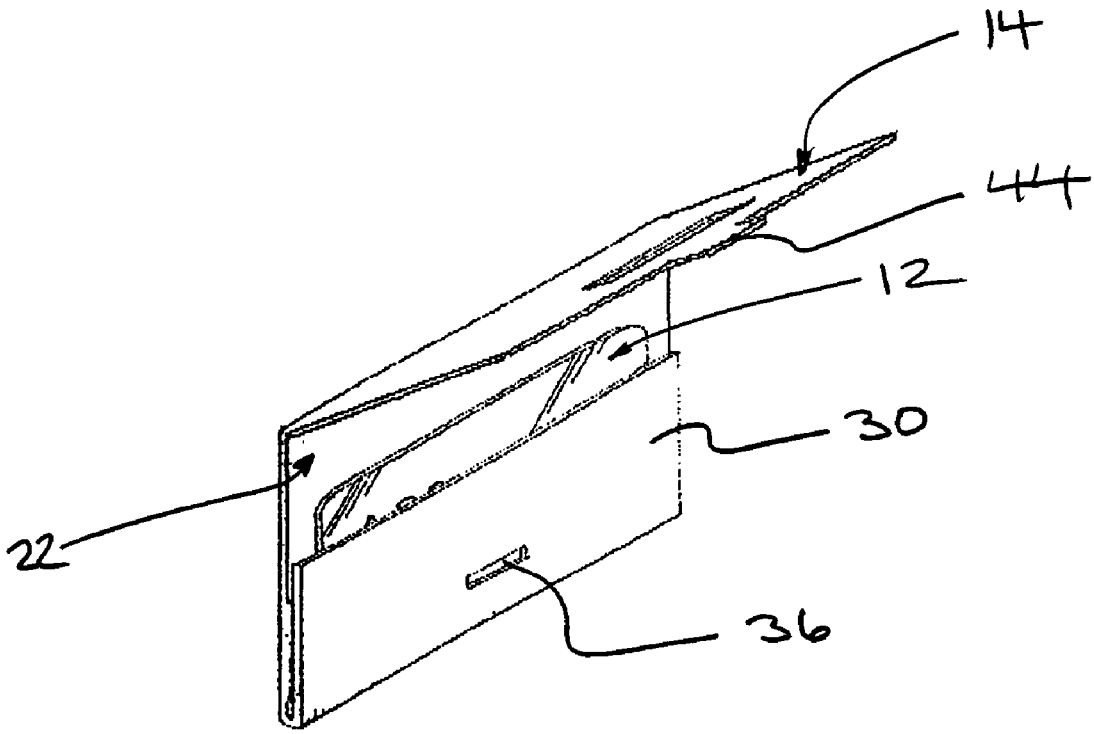
FIG. 12 is an isometric view of the carrier for a coded card illustrated in FIGS. 8 through 11, having the hang panel removed therefrom, and illustrating a subsequent step for irreversibly aesthetically converting the carrier from the two dimensional blank form into the three dimensional card-enclosing package form, with a coded card in place in the pocket formed by folding the foldable flaps and the lower portion as illustrated in FIGS. 10 and 11 and with the upper portion folded part way down towards the pocket and the coded card residing therein.
Figure 13:
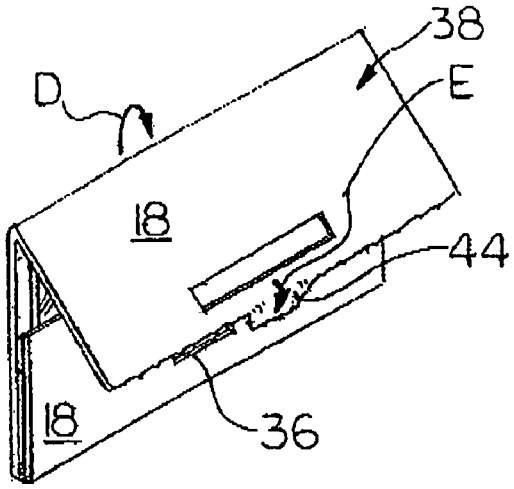
FIG. 13 is an isometric view, similar to FIG. 12, of the carrier for a coded card illustrating the final step for irreversibly aesthetically converting the carrier for the coded card from the blank form into the three dimensional card-enclosing package form, namely the insertion of the tab connected to the upper portion into the tab-receiving aperture in the lower portion, thereby to form and close the three dimensional card-enclosing package with the coded card resident therewithin.

The separation of lower panel 30 from rear surface 20 of first panel 22 provided by flaps 24 serves to define a card receptacle pocket in the space between now mutually facing rear surfaces 20 of first panel 22 and lower panel 30, as illustrated in FIGS. 11, 12 and 13.

Lower panel 30 further includes an aperture 36 formed therein. Aperture 36 is preferably located proximate the center of lower panel 30.

Blank 14 further includes an upper panel, designated generally 38 in the drawings, which is preferably of generally rectangular configuration and which is connected to first panel 22 along a fold line designated 40 in the drawings. Fold line 40 defines juncture of upper panel 38 and first panel 22 and, like fold lines 28 and 32 discussed above, is preferably scored or otherwise structurally weakened to facilitate folding.

Upper panel 38 is adapted to fold along associated juncture-defining fold line 40 towards rear surface 20 of first panel 22, as illustrated in FIG. 12 and by arrow D in FIG. 13. Upper panel 38 is adapted to be folded downwardly towards rear surface 20 of first panel 22 after folding of lower panel 30 into position facing first panel 22. In this manner and sequence of folding, upper panel 38 facingly overlies a part of lower panel 30 between aperture 36 and a now upper free edge of lower panel 30, which edge defined the lower extremity of lower panel 30 prior to folding. This free edge is designated 42 in the drawings.

Upper panel 38 further includes a tab 44 which is positioned along and extends from an upper edge extremity of upper panel 38.

Tab 44 is adapted for preferably interfering insertion into aperture 36 in lower panel 30, as shown by arrow E in FIG. 13, if such insertion is performed after the first folding of lower panel 30 into facing relationship with first panel 22 and after the second folding of upper panel 38 to overlie portion of lower panel 30 which is between aperture 36 and edge 44. Tab 44 is preferably at least equal in width and most preferably just slightly wider, perhaps a few thousandths of an inch wider, than aperture 36, so there is preferably a slight interference when tab 44 is placed into position within aperture 36. In this manner tab 44 preferably rubs against the edges of aperture 36 and retains upper panel 38 and lower panel 30 in closely facing engagement one with another, thereby to retain therewithin any coded card 12 residing within the card receptacle 34 defined by mutually facing surfaces of first panel 22 and lower panel 30. When tab 44 is inserted into aperture 36 thereby to retain upper and lower panels 38, 30 in facing overlying relationship, carrier 10 assumes the three-dimensional gift package form designated generally 16 in the drawings.

Carrier 10 preferably further includes a manually detachable apertured hang panel designated generally 48. Hang panel 48 connects to upper panel 38 along a manually separable perforate line 44, as illustrated in FIG. 8, which line defines the upper edge extremity of upper panel 38 and juncture thereof with apertured hang panel 48. Apertured hang panel 48 is adapted to be removed, as shown by arrow A in FIG. 8, and discarded before converting blank 14 into the card-enclosing gift package.

Apertured hang panel 48 preferably includes a punch-out encircled blank designated 52 in the drawings, which can be manually removed in order that carrier 10 may be displayed by being hung from a horizontal hanger rod in a retail environment. When displayed by hanging in the retail environment, carrier 10 is in the planar disposition since hang panel 48 is still affixed to upper panel 38, thereby precluding upper panel 38 from being folded as the final step in forming the three dimensional gift package. Preferably but not necessarily the card receptacle may have already been formed by folding, and preferably optionally securing with adhesive, flaps 24 and lower panel portion 30.

Upper panel 38 has been illustrated in the drawings with a card identification aperture 54 shown therein, with identification indicia on card 12 being visible through aperture 54 while card 12 is positioned on carrier 10 and carrier 10 is hanging on a hang rod in a retain environment. Card identification aperture in upper panel 38 is optional. Laws in some jurisdictions require that the card on a carrier be identifiable by the card identification indicia while the card is being offered for sale. When the carrier and card combination is sold in a jurisdiction not having this requirement, the card identification aperture 54 may not be present.

Card 12 has been illustrated mounted on upper panel 38 in a substantially symmetrical position prior to conversion of the carrier from the blank form to the three dimensional gift package; this positioning is not critical. Edges of card 12 may substantially overlie first panel 22 and/or hang panel 48 while the carrier is in the blank form since card 12 is removable from the carrier for activation, if removal is needed, and placed in the receptacle 34 after sale.

Fold lines 28, 32 and 40 are preferably created by scores in blank 14, as illustrated in FIGS. 2 through 5. Fold line 46, defining the upper extremity of upper panel 38 and juncture with aperture hang panel 48, is preferably defined by a series of cuts or perforations in blank 14 thereby to facilitate separation of apertured hang panel 48 from upper panel portion 38 when blank 14 is folded in the manner described above to form the three-dimensional gift package form of carrier 10. Depth of the scores creating fold lines 28, 32 and 40 is selected according to the material and thickness of blank 14, in accordance with known industry practice.

Surface portions of first panel 22, lower panel 30 and upper panel 38 which are exposed once blank 14 has been folded to convert carrier 10 from the blank 14 form into the three-dimensional gift package form 16, are preferably imprinted with aesthetically pleasing seasonally-oriented desired graphics and legends, most preferably Christmas-related graphics, figures and the word "To" followed by a blank for insertion of a name, and the word "From" followed by a second blank for insertion of a name. As a result, in the three-dimensional gift package form 16 of carrier 10, an aesthetically pleasing functional gift package, requiring no gift wrapping, for a coded card 12 results.

Figure 2:
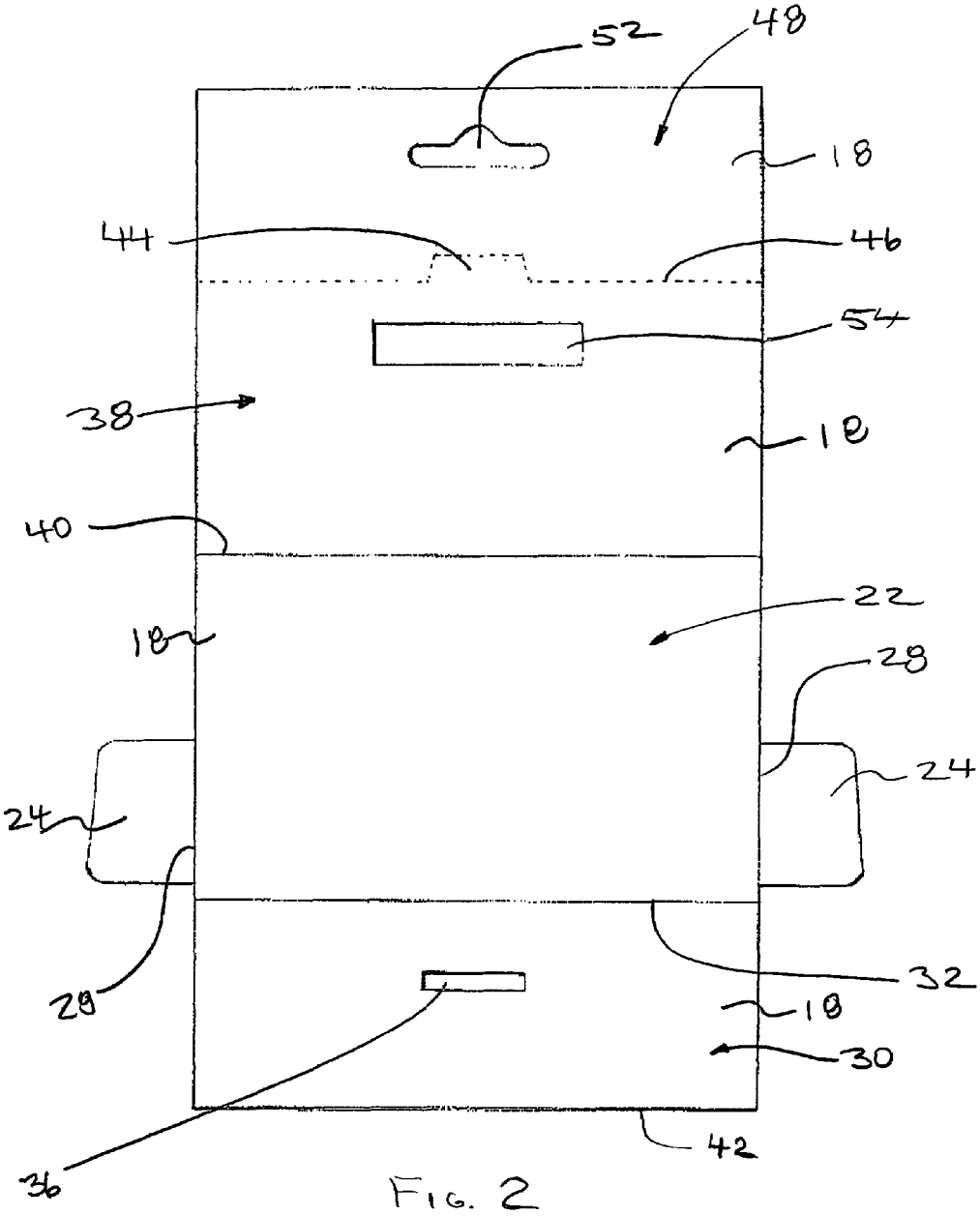
FIG. 2 is a front view of a carrier for a coded card in accordance with the preferred embodiment of the invention, similar to FIG. 1, with the carrier configured as a planar blank but without a coded card being present
Figure 14:
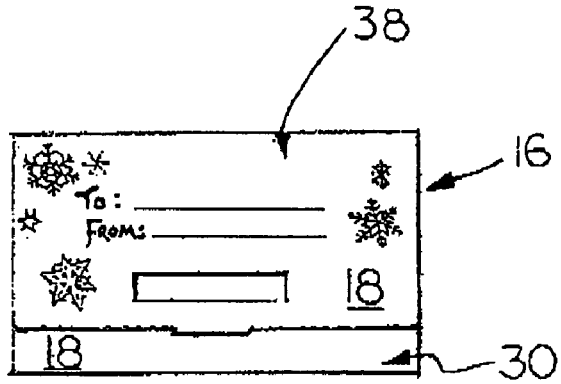
FIG. 14 is a rear view of the carrier for a coded card, illustrated in FIGS. 1 through 13, in the three dimensional package form with a coded card therewithin.
Figure 15:
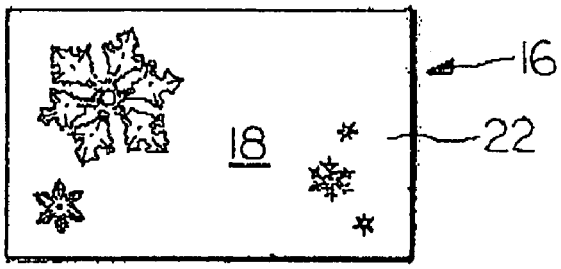
FIG. 15 is a front view of the carrier for a coded card illustrated in FIG. 14.

Any attempt to unfold carrier 10 from the gift package configuration illustrated in FIGS. 14 and 15 to the blank configuration illustrated in FIG. 2 results in disfigurement of carrier 10, as the score lines become crooked, the panels distort, especially along their surfaces, and the carrier material may tear.

Figure 3:
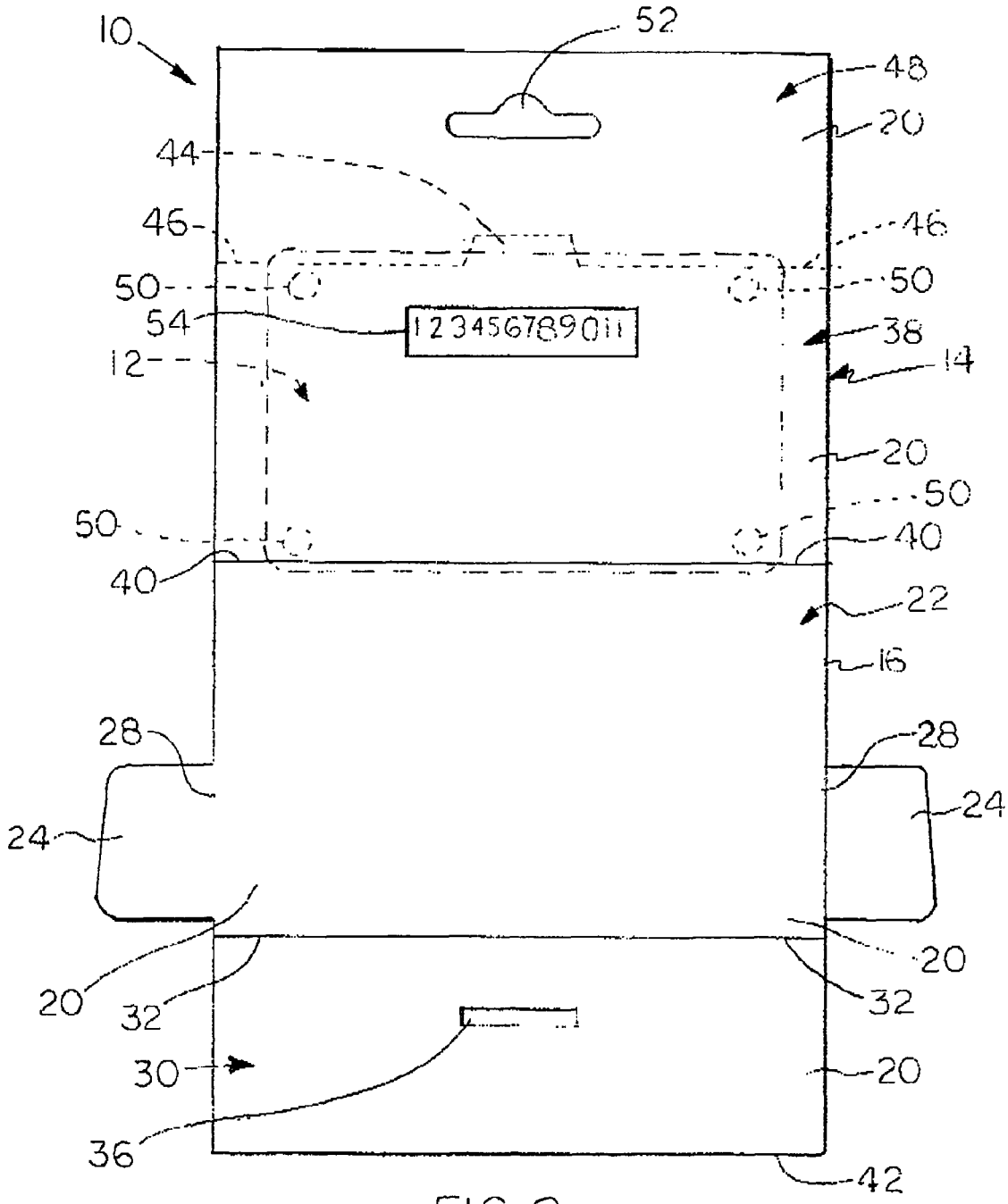
FIG. 3 is a rear view of the carrier for a coded card illustrated in FIG. 1 with the carrier configured as a planar blank and with identifying information for a coded card, which is positioned on and is removably secured to the front surface of an upper panel portion of the blank as illustrated in dotted lines, being visible through a horizontally elongated aperture in the blank. The illustrated horizontally elongated aperture through which the card identifying information is visible is optional, depending on the legal requirements of the jurisdiction in which the card carrier is sold.
Figure 4:
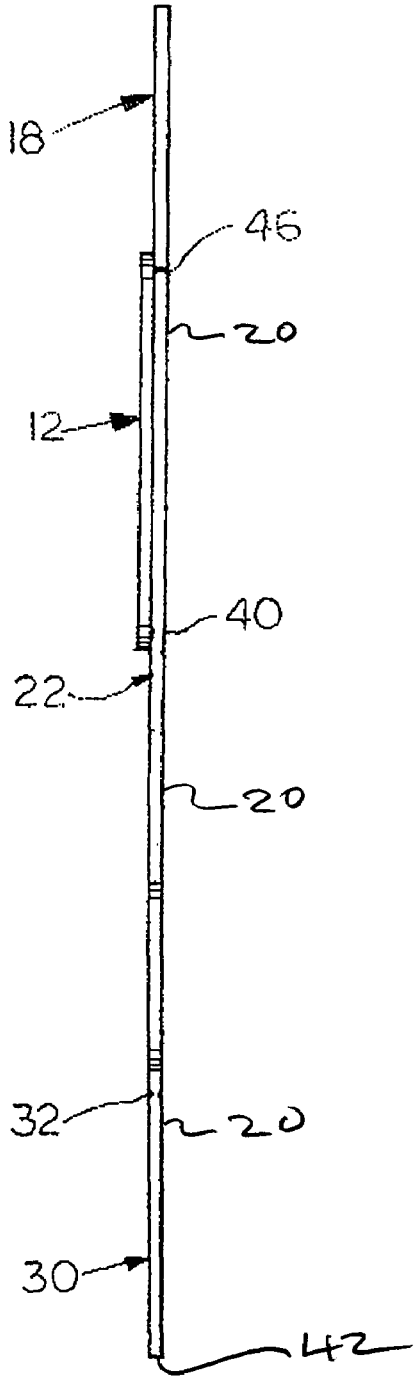
FIG. 4 is a side view of the carrier for a coded card, with the carrier configured as a blank and with a coded card positioned on and removably secured to a front surface of an upper panel portion of the blank, looking from right to left in FIG. 1.
Figure 5:
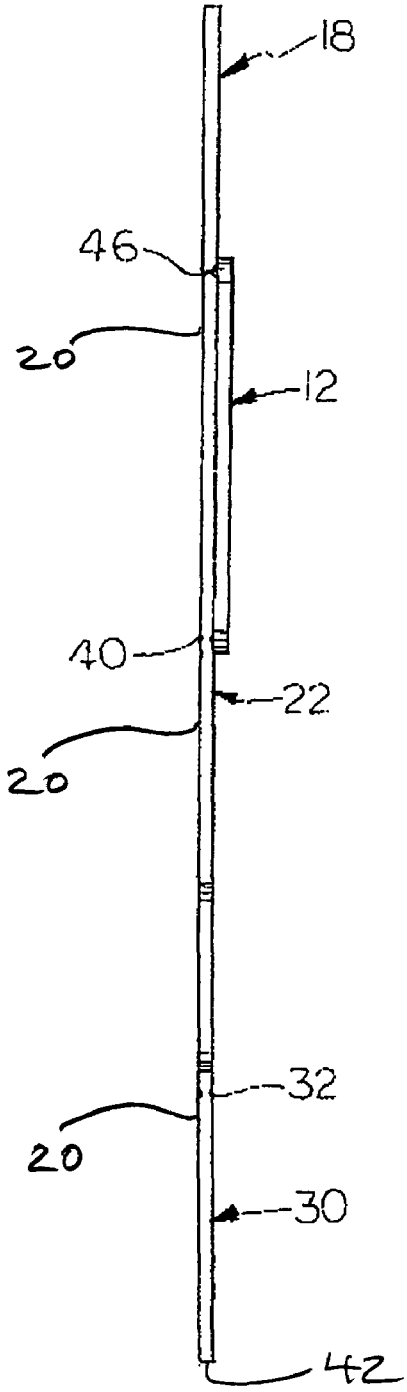
FIG. 5 is a side view of the carrier for a coded card, with the carrier configured as a blank and with a coded card positioned on and removably secured to a front surface of an upper panel portion of the blank, looking from left to right in FIG. 1.
Figure 6:
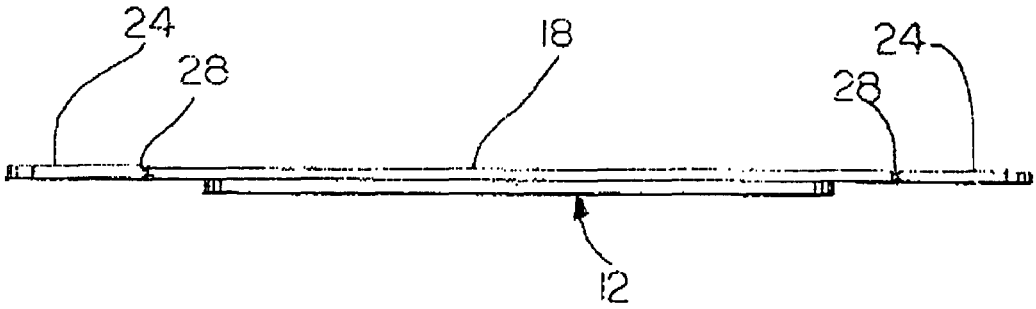
FIG. 6 is a top view of the carrier for a coded card, with a carrier configured as a blank and with a coded card positioned on and removably secured to a front surface of an upper panel portion of the blank, looking from top to bottom in FIG. 1.
Figure 7:
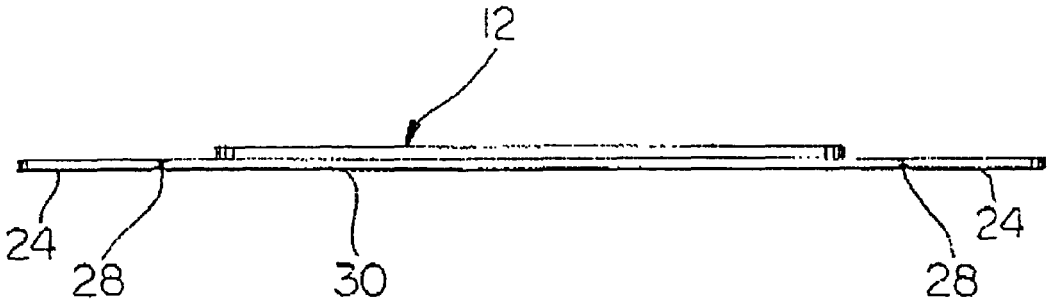
FIG. 7 is a bottom view of the carrier for a coded card, with the carrier configured as a blank and with a coded card positioned on and removably secured to a front surface of an upper panel portion of the blank, looking from bottom to top in FIG. 1.

Prior to activation of the coded card 12, card 12 is preferably adhered to the front of carrier 10 in the planar form, as generally shown in FIG. 1, for aesthetically pleasing display of carrier 10 and the coded card 12 adhered thereto. Card 12 is preferably adhered to carrier 10 using a gum or rubber-type cement, which retains card 12 in place on the carrier and yet permits card 12 to be manually removed, if necessary, from carrier 10 by retail sales personnel for card activation without disfiguring the carrier. The card-carrier adhesive is preferably applied to the card in four spots, close to each corner as illustrated in FIG. 3 where the adhesive is depicted in dotted lines and designated 50. One preferable adhesive for this purpose is produced by H B Fuller and is available as Res. #1103724002, Product #HL 2198X.

When the flaps 24 are folded against rear surface 18 of first panel 22 and lower panel 30 is folded rearwardly and upwardly against folded flaps 24 to form receptacle 34, it is desirable to retain flaps 24 and lower panel 30 in place, especially when receptacle 34 is to be formed prior to the carrier 10 being placed in the retail environment (which is the preferable manner of using carrier 10) as illustrated in FIGS. 10 and 16. In such case adhesive is preferably used to retain flaps 24 and lower panel in place after folding; a preferred adhesive for this purpose is produced by Wes Adhesives as Part # V3869B. This adhesive is not illustrated in the drawings.

The invention claimed is:

1. A planar coded card carrier that is substantially aesthetically irreversibly convertible from a substantially two dimensional blank into a three-dimensional card-enclosing gift package, comprising:

a. a blank that prior to package conversion is essentially planar, rigid cardboard, laminated with plastic on at least one side, and further comprising:

i. a first panel of generally rectangular configuration;

ii. a pair of foldable flaps connecting to said first panel oppositely one from another along fold lines defining portions of respective longitudinally elongated edges of said first panel, said flaps being adapted to fold towards one another along said fold lines to thereby overlie and facingly contact respective corresponding portions of a rear surface of said first panel, flap transverse thickness being that of a coded card to be transported by the carrier;

iii. a lower panel of generally rectangular configuration connecting to said first panel along a fold line defining juncture therebetween, adapted to fold subsequently to said flaps along said associated juncture-defining fold line upwardly to facingly overlie said rear surface of said first panel and to overlie and facingly contact said folded pair of flaps overlying respective parts of said rear surface of said first panel, to define a card receptacle pocket in space between now mutually facing surfaces of said first and lower panels and between mutually facing extremity edges of the flaps, with distance defining front to rear thickness of the receptacle pocket between the mutually facing surfaces of the first and lower panels in an area between extremities of the flaps being the thickness of the flaps and hence that of the coded card to be transported by the carrier, said lower panel having an aperture therethrough proximate the center of said lower panel of size for interfering mating receipt of a tab portion of an upper panel portion upon assembly of the carrier by sequential folding of the foldable flaps, the lower panel and the upper panel;

iv. the upper panel portion being of generally rectangular configuration connecting to said first panel portion along a fold line defining juncture therebetween, adapted to fold along said associated juncture-defining fold line towards said rear surface of said first panel portion after folding of said lower panel portion into position facing said first panel portion, to overlie a part of said lower panel portion between said aperture and a free edge of said lower panel portion which defined the lower extremity of said blank prior to folding, and including a tab portion positioned along and extending from an upper edge extremity of said upper panel portion, said tab portion being adapted for interfering mating insertion into said aperture in said lower panel portion after first folding of said lower panel portion into facing relationship with said first panel portion and after second folding of said upper panel portion to overlie said part of said lower panel portion between said aperture and said lower panel portion free edge which had defined a lower extremity of said blank prior to folding to retain said upper and lower panel portions in closely facing engagement one with another thereby to retain therewithin any card residing within said receptacle pocket;

v. a manually detachable apertured hang panel connecting to said upper panel along a manually separable perforate line defining said upper edge extremity of said upper panel portion.

2. A planar carrier for a coded card which is substantially aesthetically irreversibly convertible from a substantially two dimensional blank into a three-dimensional card-enclosing gift package, comprising:

a. a blank that prior to conversion into the three-dimensional gift package is essentially planar, said blank being essentially rigid cardboard, laminated with plastic on at least one side, and further comprising:

i. a first panel of generally rectangular configuration;

ii. a pair of foldable flaps connecting to the first panel oppositely one from another along fold lines defining portions of respective longitudinally elongated edges of the first panel, the flaps being foldable towards one another along the fold lines to thereby overlie respective portions of a rear surface of the first panel;

iii. a lower panel of generally rectangular configuration connecting to the first panel along a fold line defining juncture therebetween, being foldable subsequently to the flaps along the associated juncture-defining fold line upwardly to facingly overlie the rear surface of the first panel and to overlie and facingly contact the folded pair of flaps overlying respective parts of the rear surface of the first panel, to define a coded card receptacle pocket in space between now mutually facing surfaces of said first and lower panels and between mutually facing extremity edges of the flaps with distance defining the front to rear interior dimension of the receptacle pocket between mutually facing surfaces of the first and lower panels in an area between extremities of the flaps being the thickness of the flaps, said lower panel having an aperture therethrough proximate the center of said lower panel, the aperture being of size and shape for interfering mating receipt of a tab portion of an upper panel of the blank upon assembly of the carrier into the gift package by sequential folding of the foldable flaps, the lower panel and the upper panel;

iv. the upper panel being of generally rectangular configuration and connecting to said first panel portion along a fold line defining juncture therebetween, adapted to fold along the associated juncture-defining fold line towards the rear surface of the first panel after folding of the lower panel into position facing the first panel to overlie a part of the lower panel between the aperture and a free edge of the lower panel portion which defined the lower extremity of the blank prior to folding, and including a tab portion positioned along and extending from an upper edge extremity of the upper panel portion, the tab portion being adapted for interfering mating insertion into the aperture in the lower panel portion after first folding of the lower panel portion into facing relationship with the first panel portion and after second folding of the upper panel portion to overlie the part of the lower panel portion between the aperture and the lower panel portion free edge which had defined a lower extremity of the blank prior to folding to retain the upper and lower panel portions in closely facing engagement one with another thereby to retain therewithin any card residing within the receptacle pocket, the upper panel having a window formed therein proximate to but removed from the upper edge extremity, for facilitating reading identifying indicia of a coded card affixed to the front surface of the upper panel with coded identifying indicia on the card in registry with the window, with the open window facingly covering a portion of the lower panel between the aperture and the edge of the lower panel that formed the lower extremity of the blank prior to sequential folding of the flaps, the lower panel and the upper panel and mating insertion of the tab into the aperture to form the three dimensional gift package; and v. a manually detachable apertured hang panel connecting to said upper panel along a manually separable perforate line defining said upper edge extremity of said upper panel portion.

3. A planar carrier for a coded card which is substantially aesthetically irreversibly convertible from a substantially two dimensional blank into a three-dimensional card-enclosing gift package, comprising:

a. a non-magnetic essentially rigid planar cardboard blank comprising:

i. a first imperforate panel;

ii. at least one foldable flap having transverse thickness substantially that of the coded card connecting to said first panel along an associated first fold line and being adapted to fold along said fold line to thereby overlie and facingly contact a rear surface of said first panel;

iii. an apertured lower panel connecting to said first panel along a second fold line defining juncture therebetween, adapted to fold along said associated juncture-defining second fold line to facingly overlie said rear surface of said first panel and said folded flap overlying said rear surface of said first panel and to overlie and facingly contact the flap, to define a card receptacle pocket in space between now mutually facing surfaces of said first and lower panels with the mutually facing surfaces of the first and lower panels being spaced apart a distance equal to thickness of one of the foldable flaps and hence equal to the thickness of the coded card, and;

iv. an imperforate upper panel connecting to said first panel portion along a third fold line defining juncture therebetween, adapted to fold along said associated juncture-defining third fold line towards said rear surface of said first panel portion, to overlie a part of said lower panel portion including means insertable into the apertured lower panel for retaining said upper and lower panel portions in closely facing engagement one with another thereby to retain therewithin any card residing within said receptacle pocket.

4. A planar carrier for a coded card which is convertible from a flat blank into a three-dimensional card-enclosing gift package, comprising:

a. a rigid cardboard blank that prior to package conversion is essentially planar and comprises:

i. a first panel;

ii. flaps having transverse thickness equal to that of the coded card connecting to said first panel and adapted to fold towards one another to overlie and facingly contact a rear surface of said first panel;

iii. a lower panel, having an aperture therethrough, connecting to said first panel along a fold line defining juncture therebetween, adapted to fold along said associated juncture-defining fold line and facingly overlie said first panel and said flaps, to define a card receptacle pocket between now mutually facing surfaces of said first and lower panel with the mutually facing surfaces of the first and lower panels being spaced apart a distance equal to thickness of one of the foldable flaps and hence equal to the thickness of the coded card, said lower panel having an aperture therethrough of size and shape for interfering mating receipt of a tab portion of an upper panel of the blank upon assembly of the carrier into the gift package by sequential folding of the foldable flaps, the lower panel and the upper panel;

iv. an upper panel connecting to said first panel along a fold line defining juncture therebetween, adapted to fold towards said rear surface of said first panel, to overlie said lower panel and including tab means for retaining said upper and lower panels in closely facing engagement one with another upon tab mating insertion into said aperture thereby to retain in a resulting substantially closed three-dimensional package any card residing within what had been said receptacle pocket; the upper panel having an open, uncovered, and unoccluded window formed therein for reading identifying indicia of a coded card affixed to the front surface of the upper panel with coded identifying indicia on the card in registry with the window, with the open window facingly covering a portion of the lower panel after sequential folding of the flaps, the lower panel and the upper panel and mating insertion of the tab into the aperture to form the three dimensional gift package.

5. The carrier of claim 4 wherein said blank further comprises a detachable apertured hang panel connecting to said upper panel along a separable perforate line.

6. A method for substantially aesthetically irreversibly converting a substantially cardboard coded card carrier having:

i. a first panel of generally rectangular configuration;

ii. a pair of foldable flaps connecting to said first panel oppositely one from another along fold lines defining portions of respective longitudinally elongated edges of said first panel, and being foldable towards one another along said fold lines to thereby overlie respective portions of a rear surface of said first panel;

iii. a lower panel of generally rectangular configuration connecting to said first panel along a fold line defining juncture therebetween, and being foldable subsequently to said flaps along said associated juncture-defining fold line upwardly to facingly overlie said rear surface of said first panel and said folded pair of flaps overlying respective parts of said rear surface of said first panel, to define a coded card receptacle pocket in space between now mutually facing surfaces of said first and lower panels, said lower panel being imperforate other than a tab-receiving aperture therethrough proximate the center of said lower panel;

iv. an upper panel portion of generally rectangular configuration connecting to said first panel portion along a fold line defining juncture therebetween, and being foldable along said associated juncture-defining fold line towards said rear surface of said first panel portion after folding of said lower panel portion into position facing said first panel portion, to overlie a part of said lower panel portion between said aperture and a free edge of said lower panel portion which defined the lower extremity of said blank prior to folding, and including a tab portion positioned along and extending from an upper edge extremity of said upper panel portion, said tab portion being interferingly insertable into said aperture in said lower panel portion after first folding of said lower panel portion into facing relationship with said first panel portion and after second folding of said upper panel portion to overlie said part of said lower panel portion between said aperture and said Lower panel portion free edge which had defined a lower extremity of said blank prior to folding to retain said upper and lower panel portions in closely facing engagement one with another thereby to retain therewithin any card residing within said receptacle pocket;

v. a manually detachable apertured hang panel connecting to said upper panel along a manually separable perforate line defining said upper edge extremity of said upper panel portion;

into a three dimensional gift package for enclosing and concealing a coded card therewithin, comprising the steps of:

a. folding said pair of foldable flaps connecting to said first panel oppositely one from another along fold lines defining portions of respective longitudinally elongated edges of said first panel, towards one another along said fold lines to thereby overlie respective portions of a rear surface of said first panel;

b. folding said lower panel of generally rectangular configuration connecting to said first panel along said fold line defining juncture therebetween subsequently to said flaps along said associated juncture-defining fold line upwardly to facingly overlie said rear surface of said first panel and said folded pair of flaps overlying respective parts of said rear surface of said first panel, to define said card receptacle pocket in space between now mutually facing surfaces of said first and lower panels;

c. folding said upper panel portion of generally rectangular configuration along said fold line towards said rear surface of said first panel portion after folding of said lower panel portion into position facing said first panel portion, to overlie said lower panel portion between an aperture therein and a free edge of said lower panel portion which defined the lower extremity of said lower panel prior to folding; and, d. interferingly inserting said tab into said aperture in said lower panel portion after first folding of said lower panel portion into facing relationship with said first panel portion and after second folding of said upper panel portion to overlie said part of said lower panel portion between said aperture and said lower panel portion free edge which had defined a lower extremity of said lower panel portion prior to folding to retain said upper and lower panel portions in closely facing engagement one with another thereby to form the three dimensional gift package for retaining therewithin any coded card residing within said receptacle pocket.

7. A method for a. substantially irreversibly converting a cardboard coded card carrier having:

i. a first panel;

ii. flaps connecting to said first panel and adapted to fold towards one another to overlie a rear surface of said first panel;

iii. a lower panel connecting to said first panel along a fold line defining juncture therebetween, adapted to fold along said associated juncture-defining fold line facingly overlie said first panel and said flaps, to define a coded card receptacle pocket between now mutually facing surfaces of said first and lower panel, a tab-receiving aperture therethrough proximate the center of the lower panel;

iv. an upper panel connecting to said first panel along a fold line defining juncture therebetween, adapted to fold towards said rear surface of said first panel, to overlie said lower panel, including a tab that is interferingly matingly insertable into the aperture in the lower panel for retaining said upper and lower panel in closely facing engagement one with another thereby to retain in a resulting substantially closed three-dimensional package any card residing within what had been said receptacle pocket, the upper panel having a window formed therein proximate to but removed from the upper edge for permitting reading identifying indicia of a coded-card if affixed to the front surface of the upper panel with coded identifying indicia on the card in registry with the window;

into a three dimensional gift package for enclosing and concealing a coded card therewithin, comprising the steps of:

a. folding a pair of foldable flaps connecting to said first panel oppositely one from another along fold lines defining portions of respective longitudinally elongated edges of said first panel, towards one another along said fold lines to thereby overlie respective portions of said rear surface of said first panel;

b. folding said lower panel connecting to said first panel along a fold line defining juncture therebetween subsequently to said flaps along said associated juncture-defining fold line upwardly to facingly overlie said rear surface of said first panel and said folded pair of flaps overlying respective parts of said rear surface of said first panel, to define said card receptacle pocket in space between now mutually facing surfaces of said first and lower panels;

c. folding said upper panel portion along a fold line towards said rear surface of said first panel portion after folding of said lower panel portion into position facing said first panel portion, to overlie a part of said lower panel portion between an aperture therein and a free edge of said lower panel portion which defined the lower extremity of said lower panel prior to folding; and, d. interferingly inserting said tab into said aperture in said lower panel portion after first folding of said lower panel portion into facing relationship with said first panel portion and after second folding of said upper panel portion to overlie said part of said lower panel portion between said aperture and said lower panel portion free edge which had defined a lower extremity of said lower panel portion prior to folding to retain said upper and lower panel portions in closely facing engagement one with another thereby to retain therewithin any card residing within said receptacle pocket.

8. A coded card-carrier blank combination, the card being removably secured to the carrier, with the carrier being substantially aesthetically irreversibly convertible from substantially two dimensional planar form in which the card is secured to the carrier into a three-dimensional gift package for receipt of the coded card after the card has been removed from the carrier and for continued enclosure of the coded card in the three dimensional gift package, comprising:

a. a coded card having an identifying indicia strip on one surface of the card, being removably secured to an upper panel portion of the carrier blank and positioned thereon with the identifying indicia strip in registry with an open window formed in the upper panel portion;

b. a carrier blank, which prior to conversion into the three dimensional gift package is essentially planar, the carrier blank being cardboard laminated with plastic on at least one side, and further comprising:

i a first panel of generally rectangular configuration;

ii. a pair of foldable flaps connecting to the first panel oppositely one from another along fold lines defining portions of respective longitudinally elongated edges of the first panel, said flaps being foldable towards one another along the fold lines to overlie and facingly contact respective corresponding portions of a rear surface of the first panel, flap transverse thickness being that of the coded card;

iii. a lower panel of generally rectangular configuration connecting to the first panel along a fold line defining juncture therebetween, being foldable subsequently to the flaps along the associated juncture-defining fold line upwardly to facingly overlie the rear surface of the first panel and to overlie and facingly contact the folded pair of flaps overlying respective parts of the rear surface of the first panel, to define a receptacle pocket for the coded card in space between now mutually facing surfaces of the first and lower panels and between mutually facing extremity edges of the flaps with distance defining front to rear thickness of the receptacle pocket between the mutually facing surfaces of the first and lower panels in an area between extremities of the flaps being the thickness of the flaps and hence the thickness of the coded card, the lower panel having an aperture therethrough proximate the center of the lower panel, the aperture being of size and shape for interfering mating receipt of a portion of an upper panel portion upon assembly of the carrier into the gift package by sequential folding of the foldable flaps, the lower panel and the upper panel;

iv. the upper panel portion being of generally rectangular configuration and connecting to the first panel portion along a fold line defining juncture therebetween, being foldable along the associated juncture-defining fold line towards the rear surface of the first panel portion after folding the lower panel portion into position facing the first panel portion, to overlie a part of the lower panel portion between the aperture and a free edge of the lower panel portion that defined the lower extremity of the blank prior to folding, including a tab portion positioned along and extending from an upper edge extremity of the upper panel portion, the tab portion being interferingly matingly insertable into the aperture in the lower panel portion after first folding of the lower panel portion into facing relationship with the first panel portion and after second folding of the upper panel portion to overlie the part of the lower panel portion between the aperture and the lower panel portion free edge that had defined a lower extremity of the blank prior to folding, to retain the upper and lower panel portions in closely facing engagement one with another thereby to retain therewithin the coded card when placed within the receptacle pocket, the upper panel portion having an open window formed therein proximate to but removed from the upper edge extremity with the open window facingly covering a portion of the lower panel between the aperture and the edge of the lower panel that formed the lower extremity of the carrier blank prior to sequential folding of the flaps, the lower panel portion and the upper panel portion, and insertion of the tab portion onto the aperture to form the three dimensional gift package;

v. a manually detachable apertured hang panel connecting to the upper panel along a manually separable perforate line defining the upper edge extremity of the upper panel portion, vi. the coded card being removably affixed to the upper panel portion with the rear surface of the card facing the front surface of the upper panel portion, such that upon detaching removal of the coded card from the upper panel portion, and placement of the coded card into the receptacle pocket formed by the sequential folding of (1) the flaps towards one another to overlie and facingly contact corresponding portions of the rear surface of the first panel, (2) the lower panel upwardly to facingly overlie the rear surface of the first panel and to overlie and facingly contact the folded pair of flaps overlying respective parts of the rear surface of the first panel, and (3) the upper panel towards the rear surface of the first panel portion, and interfering mating insertion of the tab into the aperture into the now-folded lower panel portion and detachment of the hang panel, a three-dimensional package results having the coded card at least substantially concealed from view, with view of the package interior through the window in the upper panel being blocked by the portion of the lower panel underlying the window, and the coded card being completely enclosed therein, which package combination is suitable for giving the coded card as a gift.

9. The coded card-non-magnetic carrier blank combination of claim 8 in which the identifying indicia are magnetically encoded.

10. The coded card-non-magnetic carrier combination of claim 8 in which the identifying indicia are optically readable.

11. The coded card-non-magnetic carrier combination of claim 10 in which the identifying indicia are a bar code.

12. A coded card-carrier blank combination, the card being removably secured to the carrier, with the carrier being substantially aesthetically irreversibly convertible from substantially two dimensional planar form in which the card is secured to the carrier into a three-dimensional gift package for receipt of the coded card after the card has been removed from the carrier and for continued enclosure of the coded card in the three dimensional gift package, comprising:

a. a coded card having an identifying indicia strip on one surface of the card, being removably secured to an upper panel portion of the carrier;

b. a carrier blank, which prior to conversion into the three dimensional gift package is essentially planar, the carrier blank being cardboard laminated with plastic on at least one side, and further comprising:

i a first panel of generally rectangular configuration;

ii. a pair of foldable flaps connecting to the first panel oppositely one from another along fold lines defining portions of respective longitudinally elongated edges of the first panel, said flaps being foldable towards one another along the fold lines to overlie and facingly contact respective corresponding portions of a rear surface of the first panel, flap transverse thickness being that of the coded card;

iii. a lower panel of generally rectangular configuration connecting to the first panel along a fold line defining juncture therebetween, being foldable subsequently to the flaps along the associated juncture-defining fold line upwardly to facingly overlie the rear surface of the first panel and to overlie and facingly contact the folded pair of flaps overlying respective parts of the rear surface of the first panel, to define a receptacle pocket for the coded card in space between now mutually facing surfaces of the first and lower panels and between mutually facing extremity edges of the flaps with distance defining front to rear thickness of the receptacle pocket between the mutually facing surfaces of the first and lower panels in an area between extremities of the flaps being the thickness of the flaps and hence the thickness of the coded card, the lower panel having an aperture therethrough, the aperture being of size and shape for interfering mating receipt of a portion of an upper panel portion upon assembly of the carrier into the gift package by sequential folding of the foldable flaps, the lower panel and the upper panel;

iv. the upper panel portion being imperforate, of generally rectangular configuration and connecting to the first panel portion along a fold line defining juncture therebetween, being foldable along the associated juncture-defining fold line towards the rear surface of the first panel portion after folding the lower panel portion into position facing the first panel portion, to overlie a part of the lower panel portion between the aperture and a free edge of the lower panel portion that defined the lower extremity of the blank prior to folding, including a tab portion positioned along and extending from an upper edge extremity of the upper panel portion, the tab portion being interferingly matingly insertable into the aperture in the lower panel portion after first folding of the lower panel portion into facing relationship with the first panel portion and after second folding of the upper panel portion to overlie the part of the lower panel portion between the aperture and the lower panel portion free edge that had defined a lower extremity of the blank prior to folding, to retain the upper and lower panel portions in closely facing engagement one with another thereby to retain therewithin the coded card when placed within the receptacle pocket;

v. a manually detachable apertured hang panel connecting to the upper panel along a manually separable perforate line defining the upper edge extremity of the upper panel portion, vi. the coded card being removably affixed to the upper panel portion, such that upon detaching removal of the coded card from the upper panel portion, and placement of the coded card into the receptacle pocket formed by the sequential folding of (1) the flaps towards one another to overlie and facingly contact corresponding portions of the rear surface of the first panel, (2) the lower panel upwardly to facingly overlie the rear surface of the first panel and to overlie and facingly contact the folded pair of flaps overlying respective parts of the rear surface of the first panel, and (3) the upper panel towards the rear surface of the first panel portion, and interfering mating insertion of the tab into the aperture into the now-folded lower panel portion and detachment of the hang panel, a three-dimensional package results having the coded card at least substantially concealed from view and completely enclosed therein, which is suitable for giving the coded card as a gift.

* * * * *